US010058974B1

(12) United States Patent
Chen et al.

(10) Patent No.: US 10,058,974 B1
(45) Date of Patent: Aug. 28, 2018

(54) METHOD FOR CONTROLLING CHEMICAL MECHANICAL POLISHING PROCESS

(71) Applicant: Taiwan Semiconductor Manufacturing Co., Ltd., Hsinchu (TW)

(72) Inventors: Chih-Hung Chen, Hsinchu (TW); Kei-Wei Chen, Tainan (TW); Ying-Lang Wang, Taichung (TW)

(73) Assignee: TAIWAN SEMICONDUCTOR MANUFACTURING CO., LTD, Hsinchu (TW)

( * ) Notice: Subject to any disclaimer, the term of this patent is extended or adjusted under 35 U.S.C. 154(b) by 0 days.

(21) Appl. No.: 15/475,269

(22) Filed: Mar. 31, 2017

(51) Int. Cl.

| | |
|---|---|
| ***H01L 21/302*** | (2006.01) |
| ***B24B 37/013*** | (2012.01) |
| ***B24B 37/04*** | (2012.01) |
| ***B24B 49/16*** | (2006.01) |
| ***H01L 21/306*** | (2006.01) |
| ***H01L 21/321*** | (2006.01) |

(52) U.S. Cl.
CPC ..... *B24B 37/013* (2013.01); *B24B 37/042* (2013.01); *B24B 49/16* (2013.01); *H01L 21/30625* (2013.01); *H01L 21/3212* (2013.01); *H01L 2224/03616* (2013.01)

(58) Field of Classification Search
CPC . H01L 2224/03616; H01L 2224/03845; H01L 2224/11616; H01L 21/3212; H01L 21/32115; B24B 37/00; B24B 37/005; B24B 37/013
USPC ..... 438/691, 692, 693, 694; 156/345.11, 156/345.12, 345.13, 345.14, 345.15
See application file for complete search history.

(56) References Cited

U.S. PATENT DOCUMENTS

| | | | | |
|---|---|---|---|---|
| 7,189,139 | B2 * | 3/2007 | Ono | B24B 49/10 451/11 |
| 2013/0122782 | A1 | 5/2013 | Chang et al. | |
| 2014/0020830 | A1 * | 1/2014 | Rangarajan | B24B 37/013 156/345.13 |
| 2015/0371912 | A1 * | 12/2015 | Bello | B24B 37/005 438/5 |

* cited by examiner

*Primary Examiner* — Lan Vinh
(74) *Attorney, Agent, or Firm* — McClure, Qualey & Rodack, LLP

(57) ABSTRACT

A method for performing a CMP process is provided. The method includes performing the CMP process. The method further includes during the CMP process detecting a motion of a carrier head about a rotation axis beside a polishing pad. The method also includes producing a control signal corresponding to a detected result of the motion. In addition, the method includes prohibiting the rotation of the carrier head about a rotation axis by a driving motor which is controlled by the control signal. And, the method includes selecting a point of time at which the CMP process is terminated after the control signal is substantially the same as a threshold value.

20 Claims, 5 Drawing Sheets

METHOD FOR CONTROLLING CHEMICAL MECHANICAL POLISHING PROCESS

BACKGROUND

Semiconductor devices are used in a variety of electronic applications, such as personal computers, cell phones, digital cameras, and other electronic equipment. The semiconductor industry continues to improve the integration density of various electronic components (e.g., transistors, diodes, resistors, capacitors, etc.) by continual reductions in minimum feature size, which allows more components to be integrated into a given area. These smaller electronic components also require smaller packages that utilize less area than the packages of the past, in some applications.

During the manufacturing of the semiconductor devices, various processing steps are used to fabricate integrated circuits on a semiconductor wafer. Generally, the processes include a chemical mechanical polishing (CMP) process for planarization of semiconductor wafers, thereby helping to provide more precisely structured device features on the ICs. The CMP process is a planarization process that combines chemical removal with mechanical polishing. The CMP process is a favored process because it achieves global planarization across the entire wafer surface. The CMP polishes and removes materials from the wafer, and works on multi-material surfaces. Furthermore, the CMP process avoids the use of hazardous gasses, and/or is usually a low-cost process.

One problem associated with CMP is end point detection, i.e., the point at which the target material is exposed. In the past, the end point has been detected by interrupting the CMP process, removing the wafer from the polishing apparatus, and physically examining the wafer surface by techniques which ascertain film thickness and/or surface topography. If the wafer does not meet specifications, it must be loaded back into the polishing apparatus for further planarization. If excess material has been removed, the wafer may not meet specifications and will be substandard. This end point detection method is time consuming, unreliable, and costly.

Although numerous improvements to end point detection during CMP have been invented, they have not been entirely satisfactory in all respects. Consequently, it would be desirable to provide a solution to maintain the reliability and the efficiency of the CMP process.

BRIEF DESCRIPTION OF THE DRAWINGS

Aspects of the present disclosure are best understood from the following detailed description when read with the accompanying figures. It should be noted that, in accordance with the standard practice in the industry, various features are not drawn to scale. In fact, the dimensions of the various features may be arbitrarily increased or reduced for clarity of discussion.

DETAILED DESCRIPTION

Figure 1:
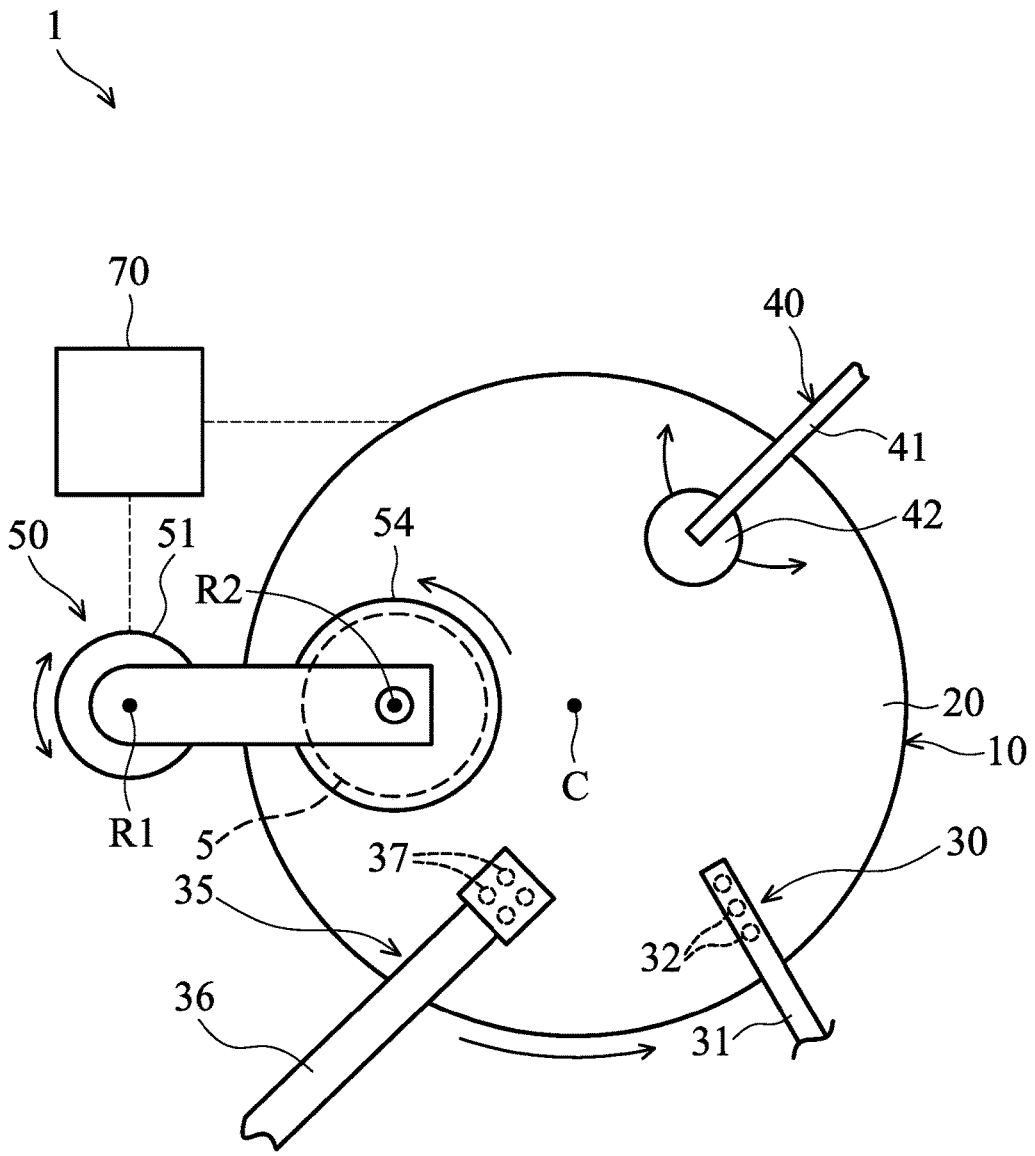
FIG. 1 shows a top view of a chemical mechanical polishing system, in accordance with some embodiments.

The following disclosure provides many different embodiments, or examples, for implementing different features of the subject matter provided. Specific examples of solutions and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. It should be understood that additional operations can be provided before, during, and after the method, and some of the operations described can be replaced or eliminated for other embodiments of the method.

One object of the embodiments below is to provide a new and improved process for chemical/mechanical polishing (CMP) of a substrate surface, wherein the end point, i.e., the polishing level at which the target material is exposed, for the planarization process is determined by monitoring wafer frictional force on a wafer side.

FIG. 1 is a schematic view of a Chemical Mechanical Polishing (CMP) system 1 as a CMP process is performed. The CMP system 1 is configured for performing a CMP process on a wafer 5 in a semiconductor manufacturing process.

The CMP system 1 includes a platen 10, a polishing pad 20, an atomizer 30, a slurry dispenser 35, a conditioning assembly 40, a wafer holder assembly 50 and a control module 70, in accordance with some embodiments. The elements of the CMP system 1 can be added to or omitted, and the disclosure should not be limited by the embodiments.

The platen 10 is configured to accept and rotate the polishing pad 20 about a center axis C. In some embodiments, the platen 10 is circular in shape. The diameter of the platen 10 lies in a range that is substantially larger than the diameter of the wafer 5 to be polished.

Figure 2:
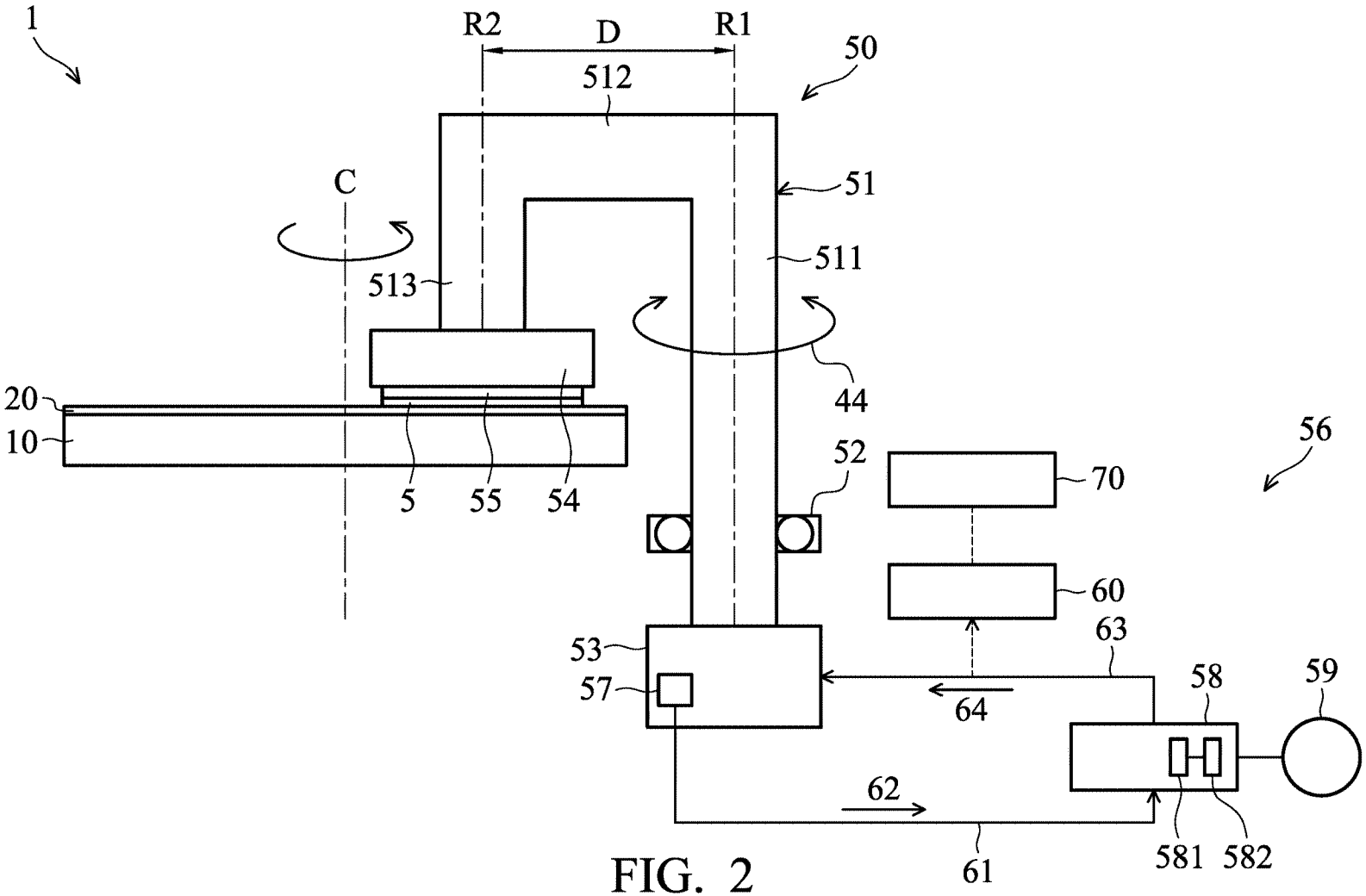
FIG. 2 shows a schematic view of a portion of a chemical mechanical polishing system, in accordance with some embodiments.

The polishing pad 20 is attached on the platen 10, as shown in FIG. 2. The polishing pad 20 may be a consumable item used in a semiconductor wafer fabrication process. The polishing pad 20 may be a hard, incompressible pad or a soft pad. For oxide polishing, hard and stiffer pads are generally used to achieve planarity. Softer pads are generally used in other polishing processes to achieve improved uniformity and a smooth surface. The hard pads and the soft pads may also be combined in an arrangement of stacked pads for customized applications.

Back to FIG. 1, the atomizer 30 is configured to supply a rinse over the polishing pad 20. In some embodiments, the atomizer 30 includes a dispenser arm 31 and a number of atomizer nozzles 32. The atomizer nozzles 32 are formed on the bottom surface of the dispenser arm 31 for supplying a high-pressure rinse over the polishing pad 20, thereby cleaning the polishing pad 20.

The slurry dispenser 35 is configured to supply slurry over the polishing pad 20. In some embodiments, the slurry dispenser 35 includes a dispenser arm 36 and a number of nozzles 37. The nozzles 37 are formed on the bottom surface of the dispenser arm 36 for supplying slurry over the polishing pad 20. The composition of the slurry supplied by the slurry dispenser 35 depends on the type of material on the wafer surface undergoing CMP. For example, tungsten slurries are typically acidic to enhance chemical etching effect on tungsten films, while copper slurries are typically basic pH to minimize corrosion of copper films.

The conditioning assembly 40 is configured for conditioning of the polishing pad 20. In some embodiments, the conditioning assembly 40 includes a conditioning arm 41 and a pad conditioner 42. The conditioning arm 41 holds pad conditioner 42 in contact with the polishing pad 20. The conditioning arm 41 moves the pad conditioner 42 in a sweeping motion across a region of the polishing pad 20. The pad conditioner 42 includes a substrate over which an array of abrasive particles, such as diamonds, is bonded using, for example, electroplating. The pad conditioner 42 removes built-up wafer debris. The pad conditioner 42 may also act as an abrasive for the polishing pad 20 to create an appropriate texture against which the wafer may be properly planarized.

The wafer holder assembly 50 is used to support the wafer 5. In some embodiments, as shown in FIG. 2, the wafer holder assembly 50 includes a shaft 51, a bearing 52, a driving motor 53, a carrier head 54, a retaining ring 55 and a wafer holder control device 56.

In some embodiments, the shaft 51 is positioned adjacent to the platen 10 and includes a first segment 511, a second segment 512 and a third segment 513. The first segment 511 extends in a rotation axis R1 around which the shaft 51 is rotated by the driving motor 53. The rotation axis R1 is parallel to the center axis C and is beside the polishing pad 20. In one embodiment, the distance between the center axis C and the rotation axis R1 is greater than the radius of the polishing pad 20. Namely, the rotation axis R1 does not pass through the polishing pad 20.

The second segment 512 is connected to one end of the first segment 511 and extends inwardly in direction that is parallel to the polishing pad 20. A portion of the projection along a direction that is parallel to the rotation axis R1 is located on the polishing pad 20. The third segment 513 is connected to one end of the second segment 512 and extends toward the polishing pad 20. The length of the third segment 513 is less than the length of the first segment 511.

A bearing 52 is configured to constrain relative motion of the shaft 51. In some embodiments, the bearing 52 is connected to the first segment 511 of the shaft 51 so as to constrain the shaft 51 to a desired sweeping motion as indicated by arrow 44 shown in FIG. 2.

The driving motor 53 is configured to control the movement of the carrier head 54 about the rotation axis R1. In some embodiments, the driving motor 53 is connected to the bottom end of the first segment 511 of the shaft 51 so as to drive the shaft 51 to rotate about the rotation axis R1.

In some embodiments, the driving motor 53 is an electric motor which converts electrical energy into mechanical energy for driving the rotation of the shaft 51. In some embodiments, the shaft 51 is driven to be rotatable about the rotation axis R1 by an external force (e.g., frictional force generated between the polishing pad 20 and the wafer 5) that is applied to the shaft 51 no matter which operation state of the driving motor 53.

The carrier head 54 is connected to the bottom end of the third segment 513 of the shaft 51. In some embodiments, the carrier head 54 is rotatable about a rotation axis R2 by another driving motor (not shown in figures) other than the driving motor 53. The rotation axis R1 is different from the rotation axis R2. The rotation axis R2 passes through the polishing pad 20 while the CMP process is performed.

The retainer retaining ring 55, which has an annular shape and a hollow center, is positioned under the carrier head 54. The wafer 5 is placed in the hollow center of retaining ring 55 during the CMP process. In some embodiments, the retaining ring 55 is composed of two pieces. The first, or upper, piece is usually of a metal material such as stainless steel, aluminum, or molybdenum, but may be other materials. The second, or lower, piece is of a plastic material such as polyphenylene sulfide (PPS), polyethylene terephthalate, polyetheretherketone, or polybutylene terephthalate.

The wafer holder control device 56 is configured to control the wafer holder assembly 50 during the CMP process. In some embodiments, the wafer holder control device 56 includes a detection circuit 57, a driving circuit 58, a power supply 59 and a monitoring sensor 60.

The detection circuit 57 is configured to detect a motion of the shaft 51. In some embodiments, the detection circuit 57 includes an RPM gauge for measuring the rotation speed of the shaft 51. The detection circuit 57 delivers an output signal 62 which corresponds to the rotation speed of the shaft 51 on a signal line 61 to the driving circuit 58. However, it should be appreciated that many variations and modifications can be made to embodiments of the disclosure. In some other embodiments, the detection circuit 57 includes a positioning sensor, such as a Hall sensor. The positioning sensor produces an electrical signal based on the orientation of the shaft 51, so that the orientation of the shaft 51 is measured.

The driving circuit 58 is configured to produce a control signal 64 for controlling the driving motor 53. The control signal 64 is produced to correspond to the detected rotation speed from the detection circuit 57. In some embodiments, the driving circuit 58 converts an input power supplied from the power supply 59 to an output power 64 based on the output signal 62 from the detection circuit 57. Afterwards, the driving circuit 58 transmits the output power 64 on the signal line 63 to the driving motor 53.

The driving circuit 58 may include a processor 581 (e.g., CPU) and a memory 582. The processor 581 may include a digital signal processor (DSP), a microcontroller (MCU), and a central processing unit (CPU). The memory 582 may include a random access memory (RAM) or another dynamic storage device or read only memory (ROM) or other static storage devices, for storing data and/or instructions to be executed by the processor 581. For example, the memory 582 may store a speed set point, i.e., an intended speed of the motor.

The monitoring sensor 60 is configured to detect the control signal 64 produced by the driving circuit 58. In some embodiments, the monitoring sensor 60 is connected to the signal line 63 and detects the output power 64 on the signal line 63. The monitoring sensor 60 may include elements for detecting electric current or voltage of the output power 64 transmitted by the driving circuit 58. However, it should be appreciated that many variations and modifications can be made to embodiments of the disclosure. In some other embodiments, the monitoring sensor 60 is formed integrally with the driving circuit 58. The monitoring sensor 60 detects electric current or voltage of the output power 64 before the output power 64 is transmitted through the signal line 63.

The CMP process control module 70 is configured to control the polish time as well as the rotation speed of the platen 10 and other variables of each polishing step of CMP system 1 in response to the detected results from the monitoring sensor 60 of the wafer holder control device 56.

The CMP process control module 70 may include at least a processor (e.g., CPU) and memory. The processor may include a digital signal processor (DSP), a microcontroller (MCU), and a central processing unit (CPU). The memory may include a random access memory (RAM) or another dynamic storage device or read only memory (ROM) or other static storage devices, for storing data and/or instructions to be executed by the processor.

For example, the CMP process control module 70 may be supplied with a computer program loaded in memory. The computer program may include preprogrammed instructions for terminating the CMP process after a preset time period when the control signal detected by the monitoring sensor 60 is substantially the same as a threshold value. Alternatively, the computer program may include preprogrammed instructions for terminating the CMP process when the amount of change in the control signal detected by the monitoring sensor 60 per unit time is gradually decreased and is smaller than a preset value.

The computer program may also include preprogrammed instructions for determining thickness of the polishing material layer, determining a desired subsequent slurry dispensing position for the slurry feeder arm in a subsequent polishing period to increase a polishing layer thickness uniformity, and outputting instructions to move the slurry feeder arm to the desired subsequent slurry dispensing position for carrying out a subsequent CMP polishing period.

Figure 3:
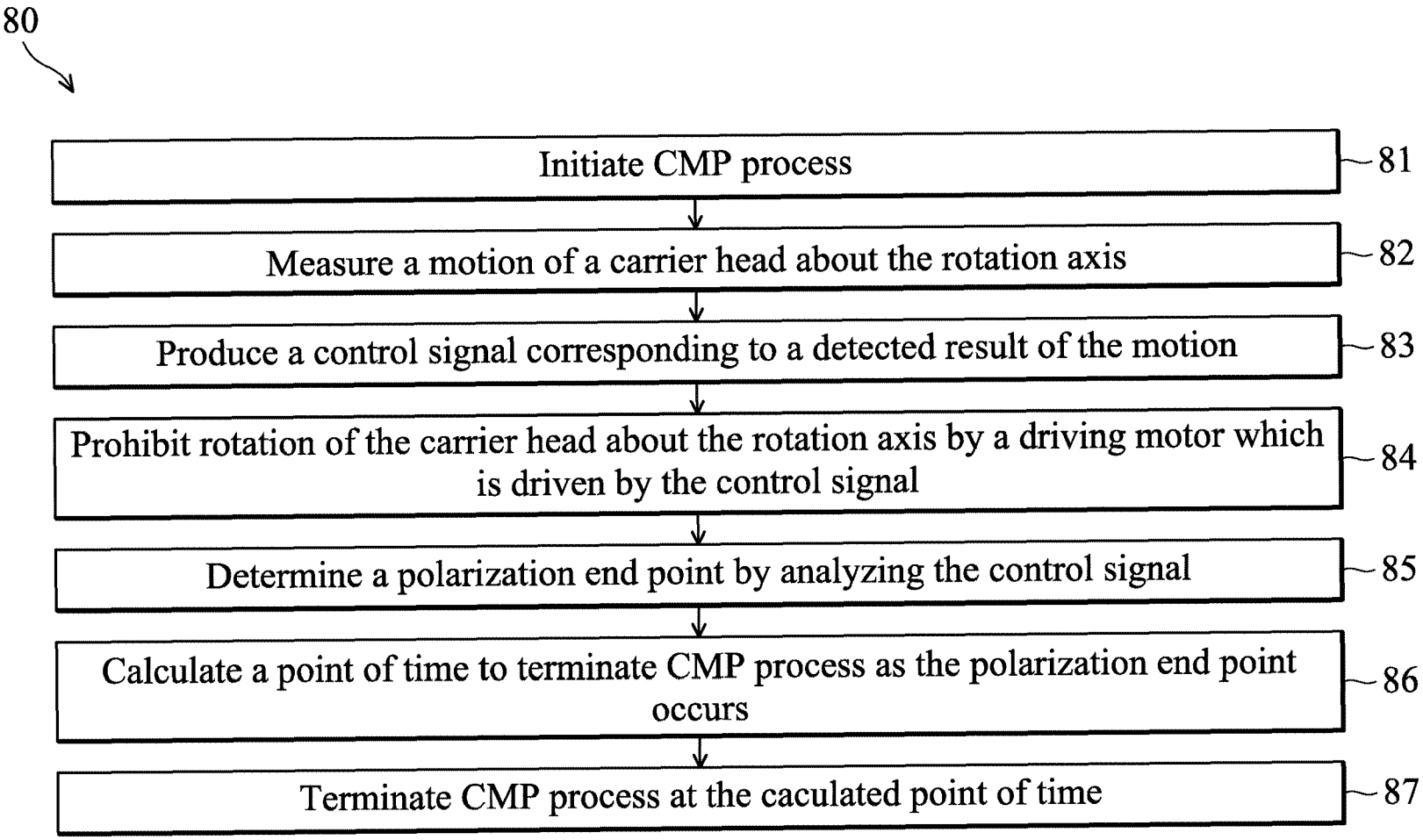
FIG. 3 shows a flow chart illustrating a method for determining polishing end point, in accordance with some embodiments.

FIG. 3 is a flow chart illustrating a method 80 for controlling processing time of a CMP process, in accordance with some embodiments. For illustration, the flow chart will be described to accompany the cross-sectional view shown in FIGS. 1-2 and 4-5. Some of the described stages can be replaced or eliminated in different embodiments. Additional features can be added to the semiconductor device structure. Some of the features described below can be replaced or eliminated in different embodiments.

The method 80 begins with an operation 81 in which a CMP process is initiated. In some embodiments, before the CMP process is initiated, the wafer 5 is mounted on the carrier head 54 of the wafer holder assembly 50.

The wafer 5 may be made of silicon or other semiconductor materials. Alternatively or additionally, the wafer 5 may include other elementary semiconductor materials such as germanium (Ge). In some embodiments, the wafer 5 is made of a compound semiconductor such as silicon carbide (SiC), gallium arsenic (GaAs), indium arsenide (InAs), or indium phosphide (InP). In some embodiments, the wafer 5 is made of an alloy semiconductor such as silicon germanium (SiGe), silicon germanium carbide (SiGeC), gallium arsenic phosphide (GaAsP), or gallium indium phosphide (GaInP). In some embodiments, the wafer 5 includes an epitaxial layer. For example, the wafer 5 has an epitaxial layer overlying a bulk semiconductor. In some other embodiments, the wafer 5 may be a silicon-on-insulator (SOI) or a germanium-on-insulator (GOI) substrate.

The wafer 5 may have various device elements. Examples of device elements that are formed in the wafer 5 include transistors (e.g., metal oxide semiconductor field effect transistors (MOSFET), complementary metal oxide semiconductor (CMOS) transistors, bipolar junction transistors (BJT), high voltage transistors, high-frequency transistors, p-channel and/or n-channel field-effect transistors (PFETs/NFETs), etc.), diodes, and/or other applicable elements. Various processes are performed to form the device elements, such as deposition, etching, implantation, photolithography, annealing, and/or other suitable processes. In some embodiments, a shallow trench isolation (STI) layer, an inter-layer dielectric (ILD), or an inter-metal dielectric layer covers the device elements formed on the wafer 5.

Figure 4:
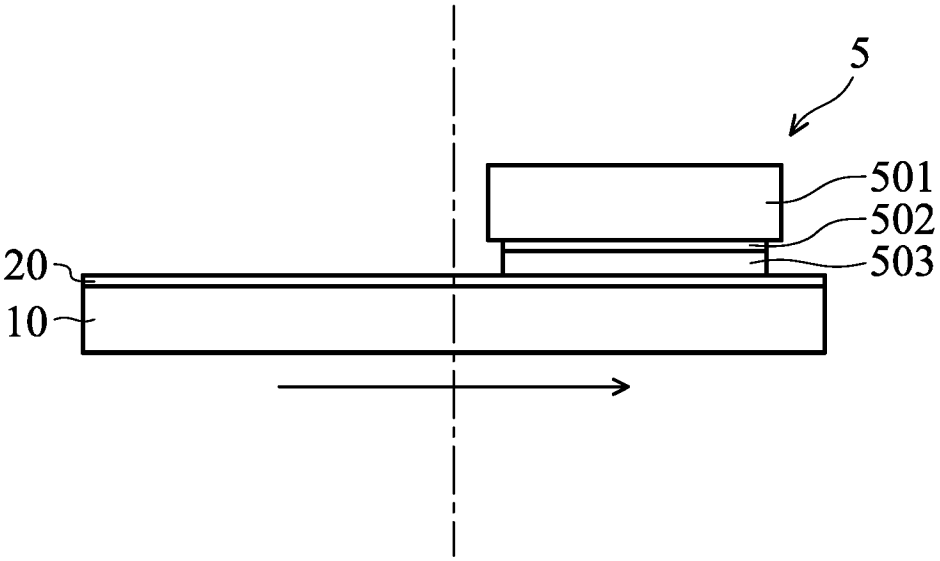
FIG. 4 shows a schematic view of one stage of a method for chemical mechanical polishing process, in accordance with some embodiments.

In some embodiments, as shown in FIG. 4, the wafer 5 includes a substrate 501, a first layer 503 and a second layer 502. The second layer 502 is formed on the substrate 501 and underlies the first layer 503. In some embodiments, the first layer 503 includes a first material such as dielectric material, and the second layer 502 includes a second material such as conducting interconnection patterns. However, it should be appreciated that many variations and modifications can be made to embodiments of the disclosure. In some embodiments, the first layer 503 includes a conducting metal, and the second layer 502 includes dielectric material.

In some embodiments, with the same normal force applied on the carrier head 54 (FIG. 2), the frictional force generated between the first layer 503 and the polishing pad 20 is different from the frictional force generated between the second layer 502 and the polishing pad 20. For example, the frictional force generated between the first layer 503 and the polishing pad 20 is smaller than the frictional force generated between the second layer 502 and the polishing pad 20.

After the wafer 5 is mounted on the carrier head 54, the carrier head 54 is lowered down to create a contact between the process surface of the wafer 5 and the polishing pad 20, and the CMP process is initiated.

In the CMP process, as shown in FIG. 1, the atomizer 30 supplies a high-pressure rinse over the polishing pad 20, and the slurry dispenser 35 supplies slurry over the polishing pad 20, and the platen 10 is rotated so that different areas of the polishing pad 20 are fed under the carrier head 54. In addition, the conditioning arm 41 sweeps the pad conditioner 42 across the areas previously used to polish the wafer 5 and conditions these areas. The platen 10 then moves these areas back under the carrier head 54 and the wafer 5. Therefore, the polishing pad 20 may be simultaneously conditioned while the wafer 5 is polished.

In some embodiments, during the CMP process, it is desired to fix the position of the carrier head 54 relative to the polishing pad 20 and prohibit the rotation of the shaft 51 about the rotation axis R1. However, the shaft 51 is driven to rotate about the rotation axis R1 by the fictional force generated between the wafer 5 and the polishing pad 20.

Figure 5:
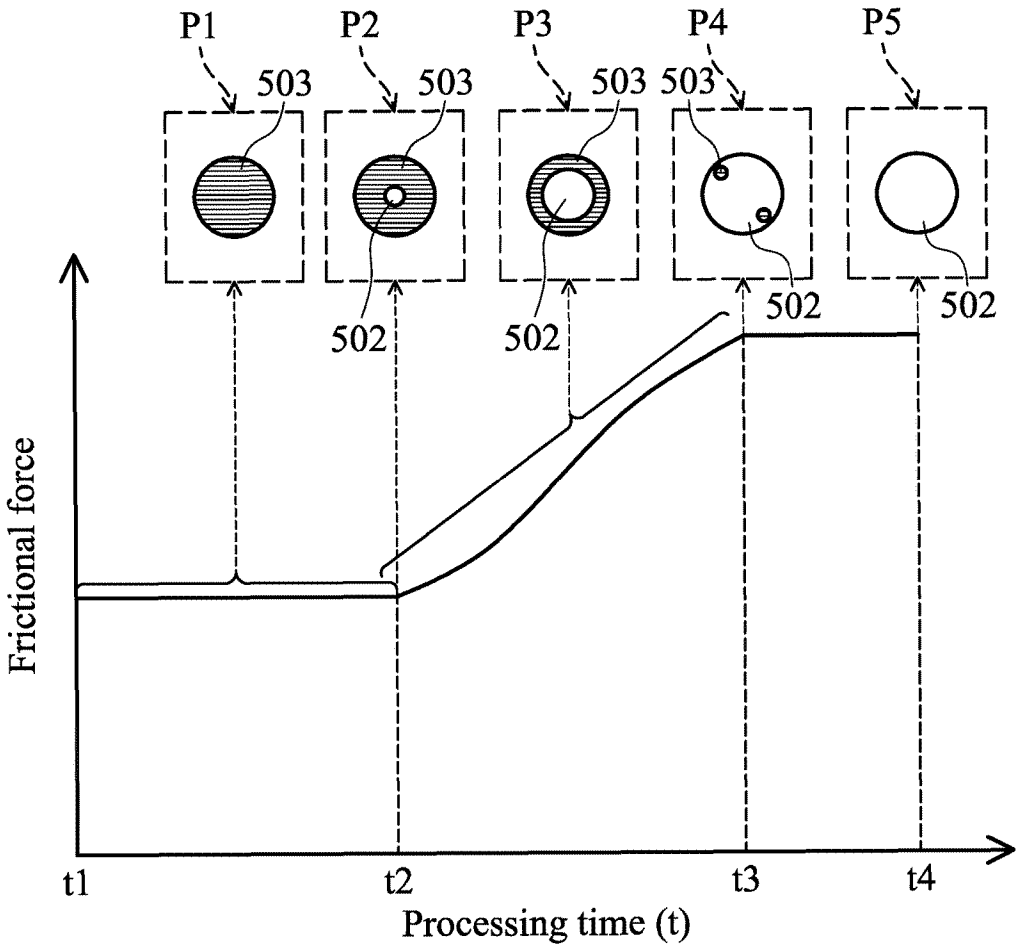
FIG. 5 is a diagram showing the relationship between time and frictional force generated between the interface of a polishing pad and a wafer.

One exemplary diagram showing the relationship between processing time and frictional force generated between the interface of the polishing pad 20 and the wafer 5 is shown in FIG. 5. For the purpose of illustration, plots P1-P5 showing bottom views of the wafer 5 in the corresponding processing times are also shown in FIG. 5.

In a time period between the processing time t1 and the processing time t2, the frictional force generated between the wafer 5 and the polishing pad 20 maintains a constant value because the second layer 502 has not been exposed, as shown in plot P1. The frictional force in this time period equals the frictional force generated between the first layer 503 and the polishing pad 20.

Around the processing time t2, the second layer exposure spots gradually appear near the center of the wafer 5, as shown in plot P2. Therefore, the frictional force generated between the wafer 5 and the polishing pad 20 is increased and the amount of change in the frictional force per unit time is gradually increased.

In a time period between the processing time t2 and the processing time t3, as shown in plot P3, the area of the second layer 502 exposure spots become larger than that at processing time t2. Therefore, the frictional force generated between the wafer 5 and the polishing pad 20 is continuously increased and the amount of change in the frictional force per unit time may be constant.

Around the processing time t3, as shown in plot P4, most of the first layer 503 is removed, and the second layer 502 exposure area is substantially equaled to the area of the process surface of the wafer 5. Therefore, the amount of change in the frictional force per unit time is gradually decreased and substantially equals to the frictional force generated between the second layer 502 and the polishing pad 20.

In some embodiments, the polarization end point is determined at the processing time t3. However, some features of the second layer 502 with tiny gaps would not be exposed and would be covered by material of the first layer 503 at this moment, which may adversely affect the subsequent processes.

Therefore, an over-polishing process is performed for a time period after the polarization end point. The time period for performing the over-polishing process from the processing time t3 to the processing time t4 may be preset according to experimental data. After the over-polishing process, the CMP process is completed, and the wafer 5 is removed from the wafer holder assembly 50.

In some embodiments, during the over-polishing process, while the effective contact surface area between the polishing pad 20 and the second layer 502 increases, the increases occur on a smaller scale of magnitude. Therefore, the frictional force generated between the wafer 5 and the polishing pad 20 is maintained at the value recorded at the processing time t3.

Based on the diagram shown in FIG. 5, since the fictional force generated between the wafer 5 and the polishing pad 20 is varied during the CMP process, the method 80 utilizes operations 82-84 to perform a real-time closed-loop control process so as to keep the shaft 51 at rest.

In operation 82, the motion of the carrier head 54 of the wafer holder assembly 50 about the rotation axis R1 is measured. In some embodiments, the rotation speed of the carrier head 54 is measured by the detection circuit 57. The detection circuit 57 issues the output signals 62 corresponding the detected rotation speed and direction to the driving circuit 58.

As illustrated in FIG. 5, the frictional force generated between the wafer 5 and the polishing pad 20 changes during the CMP process. As a result, when the frictional force generated between the wafer 5 and the polishing pad 20 is changed in the condition that the reverse force applied on the carrier head 54 by the driving motor 53 stays constant, the shaft 51 is driven to rotate about the rotation axis R1. Accordingly, the rotation speed of the shaft 51 is not zero, and the output signals 62 can show if there is a change in the frictional force generated between the wafer 5 and the polishing pad 20.

In operation 83, the driving circuit 58 produces a control signal 64 corresponding to the output signals 62 from the detection circuit 57. In some embodiments, when the rotation speed of the shaft 51 about the rotation axis R1 is not equal to zero, the driving circuit 58 adjusts the control signal 64 to prohibit the rotation of the shaft 51 about the rotation axis R1.

In some embodiments, the control signal includes an output power. In cases where the rotation direction of the shaft 51 is the same as that of the platen 10, the frictional force generated between the wafer 5 and the polishing pad 20 is increased. Thus, the output power from the driving circuit 58 is increased according to the detected rotation speed so as to actuate the driving motor 53 to generate more output torque to move the shaft 51 back to the original position.

In cases where the rotation direction of the shaft 51 is opposite to that of the platen 10, the frictional force generated between the wafer 5 and the polishing pad 20 is decreased. Thus, the output power from the driving circuit 58 is decreased according to the detected rotation speed so as to actuate the driving motor 53 to generate less output torque. As a result, the shaft 51 is moved back to the original position by the friction force.

In one exemplary example, method for determining increasing or decreasing output power by the detection circuit may include comparing the signal corresponding to the rotation of the shaft 51 with a lookup table (not shown) to determine whether or not to adjust the output power.

In some embodiments, since the rotation speed of the shaft 51 is substantially maintained at zero, the motor energy loss and the bearing energy loss can be assumed to be negligible. As a result, the output power from the driving circuit 58 to the driving motor 53 is proportional to the output torque of the driving motor 53.

In addition, the output torque of the driving motor 53 is substantially equal to a product of a frictional force, generated between the wafer 5 and the polishing pad 20, and a distance D (FIG. 2), formed between the rotation axis R1 and a center of the carrier head 54 (i.e., the rotation axis R2).

In operation 84, the rotation of the shaft 51 about the rotation axis R1 is prohibited by the driving motor 53 which is driven by the control signal 64. In some embodiments, to prohibit the rotation of the shaft 51, the driving motor 53 is driven to provide a reverse force on the shaft 51 against the fictional force generated between the wafer 5 and the polishing pad 20 according to the control signal 64 from the driving circuit 58.

The method 80 continues with operation 85, in which a polarization end point is determined by analyzing the control signal 64 from the driving circuit 58. In some embodiments, the output power from the driving circuit 58 is proportional to the frictional force generated between the wafer 5 and the polishing pad 20. Therefore, the polarization end point can be determined by analyzing the control signal delivered from the driving circuit 58 according to the relationship between frictional force and processing time shown in FIG. 5.

In some embodiments, the output power is detected by the monitoring sensor 60 that is connected to the driving circuit 58. In cases where the voltage of the output power from the driving circuit 58 is held constant, the monitoring sensor 60 detects the electric current of the output power. Afterwards, the detected signal is transmitted to the control module 70 and analyzed by the control module 70.

In some embodiments, the control module 70 determines that the polarization end point is achieved when the output power is substantially the same as a threshold value. The threshold value may include a value for the electric current. The threshold value may be a previously determined value which is known to expose the target material (e.g., second layer 502 shown in FIG. 4) on the wafer 5. Specifically, the control module 70 may compare the signal corresponding to the electric current with a lookup table (not shown) to determine whether or not to issue a signal to stop CMP process.

In some embodiments, the control module 70 determines that the polarization end point is achieved when the amount of change in the electric current per unit time is gradually decreased and is smaller than a preset value. For example, when the amount of change in the electric current per second is smaller than 100 mA/sec, the control module 70 determines that the polarization end point is achieved. In such a manner, even if the control signal cannot reach the threshold value due to some noise signals produced during the CMP process, the polarization end point can be determined. It should be appreciated that the amount of change in the electric current may vary significantly between different applications, not limited to the embodiments.

The method 80 continues with operation 86, in which a point of time at which to terminate the CMP process is calculated as the polarization end point occurs. In some embodiments, the point of time at which to terminate CMP process is calculated by the control module 70. The point of time may be a previously determined value which is known to provide the desired quantity of material removal from the wafer 5. Afterwards, the method 80 continues with operation 87, in which the CMP process is terminated at the calculated point of time in operation 86.

Embodiments of system and method for performing a CMP process are provided. The CMP process is controlled according to the wafer frictional force which is monitored by a sensor mounted on a wafer holder assembly. Since measurement noise (i.e., variables which do not relate to the wafer frictional force) is not detected by the sensor, a higher accuracy wafer frictional force can be recorded and a polarization end point is precisely determined. Therefore, the wafer can be processed according to design requirements, and the uniformity of device performance within a die (WID) is improved.

In accordance with some embodiments, a method for performing a CMP process is provided. The method includes performing the CMP process by creating a contact between a polishing pad and a substrate held by a carrier head. The carrier head is moveable about a rotation axis which is beside the polishing pad. The method further includes during the CMP process detecting a motion of the carrier head about the rotation axis by a detection circuit. The method also includes producing a control signal corresponding to a detected result of the motion from the detection circuit. In addition, the method includes prohibiting the rotation of the carrier head about the rotation axis by a driving motor which is controlled by the control signal. And, the method includes selecting a point of time at which the CMP process is terminated after the control signal is substantially the same as a threshold value.

In accordance with some embodiments, a method for performing a CMP process is provided. The method includes performing the CMP process by creating a contact between a polishing pad and a substrate held by a carrier head. The carrier head is moveable about a rotation axis which is beside the polishing pad. The method further includes during the CMP process detecting a motion of the carrier head about the rotation axis by a detection circuit. The method also includes producing a control signal corresponding to a detected result of the motion from the detection circuit. In addition, the method includes prohibiting the rotation of the carrier head about the rotation axis by a driving motor which is controlled by the control signal. And, the method includes selecting a point of time at which the CMP process is terminated when the amount of change in the control signal per unit time is gradually decreased and is smaller than a preset value.

In accordance with some embodiments, a CMP system is provided. The system includes a carrier head. The carrier head is rotatable about a rotation axis. The further system includes a driving motor. The driving motor is connected to the carrier head and is used to control the movement of the carrier head about the rotation axis. The also system includes a detection circuit. The detection circuit is connected to the driving motor and is used to detect a motion of the driving motor. In addition, the system includes a driving circuit. The driving circuit is connected to the detection circuit and is used to produce a control signal corresponding to the detected motion from the detection circuit. The driving motor prohibits the rotation of the carrier head according to the control signal produced by the driving circuit. And, the system includes a monitoring sensor. The monitoring sensor is connected to the driving circuit and configured to detect the control signal produced by the driving circuit.

Although the embodiments and their advantages have been described in detail, it should be understood that various changes, substitutions, and alterations can be made herein without departing from the spirit and scope of the embodiments as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A method for performing a CMP process, comprising:

performing the CMP process by creating a contact between a polishing pad and a substrate held by a carrier head, wherein the carrier head is moveable about a rotation axis which is beside the polishing pad, wherein the substrate comprises a first layer comprising a first material and a second layer underlying the first layer and comprising a second material;

during the CMP process detecting a motion of the carrier head about the rotation axis by a detection circuit;

producing a control signal corresponding to a detected result of the motion from the detection circuit;

prohibiting the rotation of the carrier head about the rotation axis by a driving motor which is controlled by the control signal, wherein the control signal is proportional to an output torque of the driving motor; and selecting a point of time at which the CMP process is terminated after the control signal is substantially the same as a threshold value, wherein when the control signal is substantially the same as the threshold value, the output torque of the driving motor remains at a value that is substantially equal to a product of a frictional force, generated between the second layer and the polishing pad, and a distance, formed between the rotation axis and a center of the carrier head.

2. The method for performing the CMP process as claimed in claim 1, wherein the CMP process is terminated after a preset time period when the control signal is substantially the same as the threshold value.

3. The method for performing the CMP process as claimed in claim 1, wherein the rotation axis is parallel to a center axis about which the polishing pad is rotated, and the rotation axis and the center axis separated by a distance that is greater than the radius of the polishing pad.

4. The method for performing the CMP process as claimed in claim 1, wherein a frictional force generated between the first layer and the polishing pad is different from the frictional force generated between the second layer and the polishing pad.

5. The method for performing the CMP process as claimed in claim 1, wherein the detection of the motion of the carrier head about the rotation axis comprising detect a rotation speed and a rotation direction of the carrier head.

6. The method for performing the CMP process as claimed in claim 1, wherein the control signal comprises an output power of a driving circuit, and the driving motor is controlled by the output power.

7. The method for performing the CMP process as claimed in claim 6, further comprising detecting an electric current of the output power, wherein the CMP process is terminated when the electric current is substantially the same as the threshold value.

8. The method for performing the CMP process as claimed in claim 6, wherein the detection of the motion of the carrier head comprises detecting the output power by the detection circuit which is connected to the driving circuit via a signal line.

9. The method for performing the CMP process as claimed in claim 6, wherein the detection of the motion of the carrier head comprises detecting the output power by the detection circuit which is formed integrally with the driving circuit.

10. A method for performing a chemical mechanical polishing (CMP) process, comprising:

performing the CMP process by creating a contact between a polishing pad and a substrate held by a carrier head, wherein the carrier head is moveable about a rotation axis which is beside the polishing pad, wherein the substrate comprises a first layer composed of a first material and a second layer underlying the first layer and composed of a second material;

during the CMP process detecting a motion of the carrier head about the rotation axis by a detection circuit;

producing a control signal corresponding to a detected result of the motion from the detection circuit;

prohibiting the rotation of the carrier head about the rotation axis by a driving motor which is controlled by the control signal, wherein the control signal is proportional to an output torque of the driving motor; and selecting a point of time at which the CMP process is terminated when the amount of change in the control signal per unit time is gradually decreased and is smaller than a preset value, wherein when the amount of change in the control signal per unit time is smaller than a preset value, the output torque of the driving motor remains at a value that is substantially equal to a product of a frictional force, generated between the second layer and the polishing pad, and a distance, formed between the rotation axis and a center of the carrier head.

11. The method for performing the CMP process as claimed in claim 10, wherein the CMP process is terminated after a preset time period when the amount of change in the control signal per unit time is smaller than the preset value.

12. The method for performing the CMP process as claimed in claim 10, wherein the rotation axis is parallel to a center axis about which the polishing pad is rotated, and the rotation axis and the center axis are separated by a distance that is greater than the radius of the polishing pad.

13. The method for performing the CMP process as claimed in claim 10, wherein a frictional force generated between the first layer and the polishing pad is different from the frictional force generated between the second layer and the polishing pad.

14. The CMP system as claimed in claim 10, wherein the detection of the motion of the carrier head about the rotation axis comprising detect a rotation speed and a rotation direction of the carrier head.

15. The method for performing the CMP process as claimed in claim 10, wherein the control signal comprises an output power of a driving circuit, and the driving motor is controlled by the output power.

16. The method for performing the CMP process as claimed in claim 15, further comprising detecting an electric current of the output power, wherein the CMP process is terminated when the amount of change in the electric current per unit time is smaller than the preset value.

17. The method for performing the CMP process as claimed in claim 15, wherein the detection of the motion of the carrier head comprises detecting the output power by the detection circuit which is connected to the driving circuit via a signal line.

18. The method for performing the CMP process as claimed in claim 15, wherein the detection of the motion of the carrier head comprises detecting the output power by the detection circuit which is integral with the driving circuit.

19. A chemical mechanical polishing (CMP) system, comprising:

a polishing pad;

a carrier head rotatable about a rotation axis which is beside the polishing pad and configured to hold a substrate comprising a first layer composed of a first material and a second layer underlying the first layer and composed of a second material;

a driving motor connected to the carrier head and configured to control the movement of the carrier head about the rotation axis;

a detection circuit connected to the driving motor and configured to detect a motion of the driving motor;

a driving circuit connected to the detection circuit and configured to produce a control signal corresponding to the detected motion from the detection circuit, wherein the driving motor prohibits the rotation of the carrier head according to the control signal produced by the driving circuit, and the control signal is proportional to an output torque of the driving motor;

a monitoring sensor connected to the driving circuit and configured to detect the control signal produced by the driving circuit; and a control module configured to control a polish time of the substrate, wherein a point of time at which the polish time is terminated is selected when the output torque of the driving motor remains at a value that is substantially equal to a product of a frictional force, generated between the second layer and the polishing pad, and a distance, formed between the rotation axis and a center of the carrier head.

20. The CMP system as claimed in claim 19, wherein the monitoring sensor comprises a device for detecting and measuring an electric current of the control signal.

* * * * *